US006547482B2

(12) United States Patent
Schwörer

(10) Patent No.: US 6,547,482 B2
(45) Date of Patent: Apr. 15, 2003

(54) HOOK STRAP

(75) Inventor: Artur Schwörer, Senden (DE)

(73) Assignee: Peri GmbH, Weissenhorn (DE)

( * ) Notice: Subject to any disclaimer, the term of this patent is extended or adjusted under 35 U.S.C. 154(b) by 0 days.

(21) Appl. No.: 09/733,222

(22) Filed: Dec. 8, 2000

(65) Prior Publication Data

US 2002/0127054 A1 Sep. 12, 2002

(30) Foreign Application Priority Data

Dec. 15, 1999 (DE) ..... 199 60 456

(51) Int. Cl.[7] ..... E04B 1/38

(52) U.S. Cl. ..... 403/386; 403/388; 403/392; 52/712

(58) Field of Search ..... 403/386, 388, 403/400, 392, 393, 395, 396, 384, 373; 52/712, 715

(56) References Cited

U.S. PATENT DOCUMENTS 2,891,296 A * 6/1959 Darde ..... 403/391
4,022,537 A * 5/1977 Gilb et al. ..... 403/386
4,527,375 A * 7/1985 Braginetz ..... 52/712
4,592,186 A * 6/1986 Braginetz ..... 403/400 X
5,259,165 A * 11/1993 Koyama ..... 403/388 X
5,423,156 A * 6/1995 Nellessen, Jr. ..... 403/400 X
5,448,871 A * 9/1995 Newman et al. ..... 52/712

FOREIGN PATENT DOCUMENTS

CH 577 097 A5 6/1976
DE 2260359 6/1974 ..... E04G/17/04
DE 31 48 217 A1 6/1983

* cited by examiner

*Primary Examiner*—Lynne H. Browne
*Assistant Examiner*—John Cottingham
(74) *Attorney, Agent, or Firm*—Polster, Lieder, Woodruff & Lucchesi L.C.

(57) ABSTRACT

A hook strap comprises a transverse arm formed as a ribbon for abutment on an top flange on a formwork girder. The ends of the ribbon are provided with hook-shaped retainers for engagement below parts of a waler and tension elements for fixing the hook strap. The ribbon has a small thickness to prevent obstruction of the elements bordering the top flange and the upper surface of the top flange. The hook strap may be mounted at any location of a formwork girder or of a waler to interconnect formwork girders and/or connect formwork girders to a waler.

14 Claims, 2 Drawing Sheets

HOOK STRAP

This application claims Paris Convention priority of German patent application number 199 60 456.8-25 filed Dec. 15, 1999 the complete disclosure of which hereby incorporated by reference.

BACKGROUND OF THE INVENTION

The invention concerns a hook strap comprising a transverse arm for abutment on a formwork girder, comprising hook-shaped retainers, disposed at the opposing ends of the transverse arm, for engagement below parts of a waler, and comprising tension elements for fixing the hook strap.

A hook strap of this type is disclosed e.g. in the publication DE 22 60 359 A1.

A hook strap is a means for mounting walers to a formwork girder onto which a formwork panel can be mounted and fixed to the top flange. The assembly of formwork panels includes disposing the formwork girder above the walers and rigidly connecting them by means of the hook straps.

The known hook strap is intended only for connecting walers with a lattice girder. The transverse arm of the known hook strap is guided between lattice struts of a lattice girder and can be disposed only transversely to the lattice girder in the area of a junction of two lattice struts which provides a predetermined grid for aligning the walers with respect to the formwork girders. Disadvantageously, the walers cannot be mounted at any location. The connection of two girders, at least one of which does not comprise a lattice profile, can be realized with the known hook strap only if one girder has a through-opening in the area of the waler.

It is the underlying purpose of the present invention to produce a hook strap which can be mounted at any location of a formwork girder or a waler for connecting the formwork girder with the waler.

SUMMARY OF THE INVENTION

The above-mentioned object is achieved by a hook strap having a transverse arm formed by a flat ribbon of small thickness. This embodiment allows many different applications of the hook strap according to the invention. At first, the formwork girder and the waler are aligned transversely to one another. Mounting of the hook strap is achieved in that the ribbon-shaped flat transverse arm is disposed onto an outer side of a girder, preferably onto the upper side facing the formwork panel, i.e. the top flange, and subsequently, the tension members engage on the transverse arm. Gradual setting and adaptation of the hook strap in accordance with the invention is possible via said tension elements.

It is possible to select any position on the outer side of the girder since the flat design of a ribbon as a transverse arm does not limit or impede application of the formwork panel. The flat ribbon can be pressed into or adjusted to the material through application of the tension elements such that the surface produced is largely uniform without projecting steps or edges.

The ribbon may be made of a thin metal sheet (steel or spring steel sheet) which, when tensioning the hook strap in accordance with the invention on the girders, adapts optimally to the surface contour of an top flange like a film. The ribbon fits closely on the top flange under tensile stress and can accommodate all forces which occur during tensioning of the tension elements. The ribbon may also be produced of filaments and in addition to metal, also carbon and/or plastic fibers can be used for producing a ribbon for the hook strap in accordance with the invention.

In one embodiment of the invention, the ribbon is approximately 70 mm wide and has a thickness of less than 1 mm, preferably 0.2 mm. A thin designed ribbon of this thickness allows gradual smooth and discreet transition from the surface of the girder to the waler supported on the girder.

The ribbon of the inventive hook strap does not have to be preformed. Therefore, it can be applied to girders of different widths. Under tension, the ribbon adapts to girders of different widths. Since the ribbon does not penetrate but overlap the girder, it is possible to interconnect the most different girder constructions through the inventive hook strap. The junction points on the lattice girders or openings on the girders can be neglected.

If the tension elements are formed by studs of different lengths with screw heads and a tensioning nut, the hook strap can be easily adapted to different girder heights or bolt heights of girders to be connected and to different walers. The ribbon can be adapted to different girder widths without having to change its length.

It is advantageous thereby that some of the ends of the hook-shaped retainers are remote from the flange of a girder which the other ends partially engage beyond. This allows spreading of the retainers in the tension-free state as well as adaptation to the width of the girder beyond which they are intended to engage. Small angular deflections on the retainers effect a great change of the separation between the free ends of the retainers. The smaller the distance between the supporting point of the retainers and the top flange, the larger the adaptation range of the retainers to the most various girder sizes.

It is possible to provide angle sections to reinforce the edge sections. The ribbon may be formed of a tension-proof material (carbon fibers, metal fibers, plastic fibers, carbon metal or plastic ribbons) having thin walls, almost like a foil. The angle sections can accommodate the forces triggered by the clamping elements and introduce them into the ribbon to stress the ribbon uniformly.

The preferred material for the transverse arm formed as flat thin ribbon is spring steel.

The ribbon ends may be welded to the angle sections and/or contained in the angle sections such that the ribbon surrounds the angle sections once or several times to ensure that the ribbon cannot get detached from the angle sections even when large tensioning forces act on the ribbon.

BRIEF DESCRIPTION OF THE DRAWING

The drawing shows embodiments of the inventive hook strap in a highly schematized fashion. The embodiments of the inventive hook strap are not true to scale. In the drawings.

DESCRIPTION OF THE PREFERRED EMBODIMENTS

Figure 1:
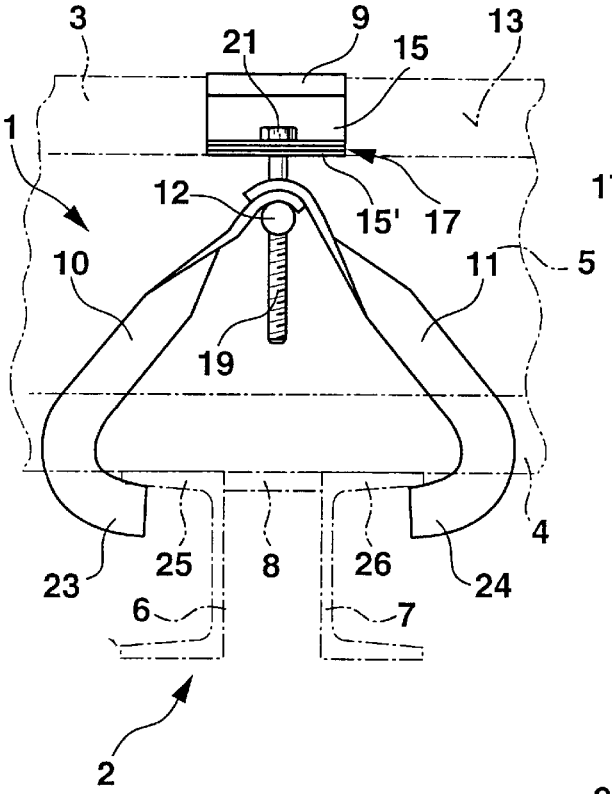
FIG. 1 shows a side view of a hook strap in the mounted state.
Figure 2:
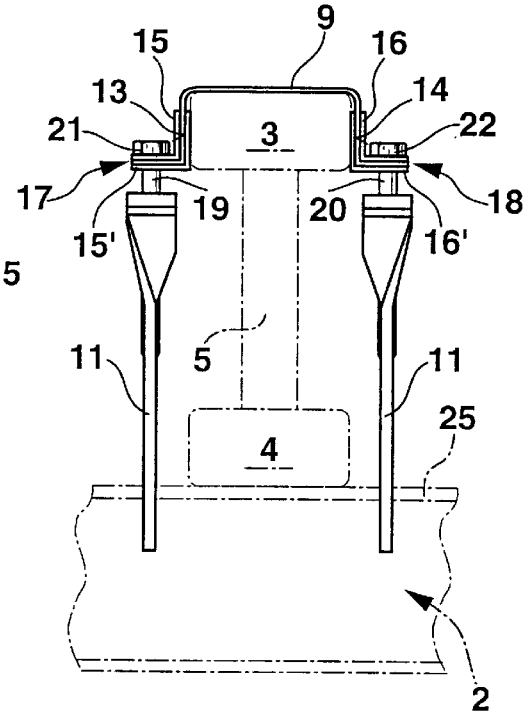
FIG. 2 shows a side view of the hook strap of FIG. 1.

FIG. 1 and FIG. 2 show a formwork girder 1 which is rigidly connected to a waler 2 extending transversely to said formwork girder 1 and abutting on the formwork girder 1. The formwork girder 1 consists of an top flange 3 and a bottom flange 4 connected to the top flange 3 via a strut 5. The waler 2 is formed by two U-shaped profiles 6 and 7 which are interconnected via a spacer 8 thereby forming a double U-girder.

Figure 3:
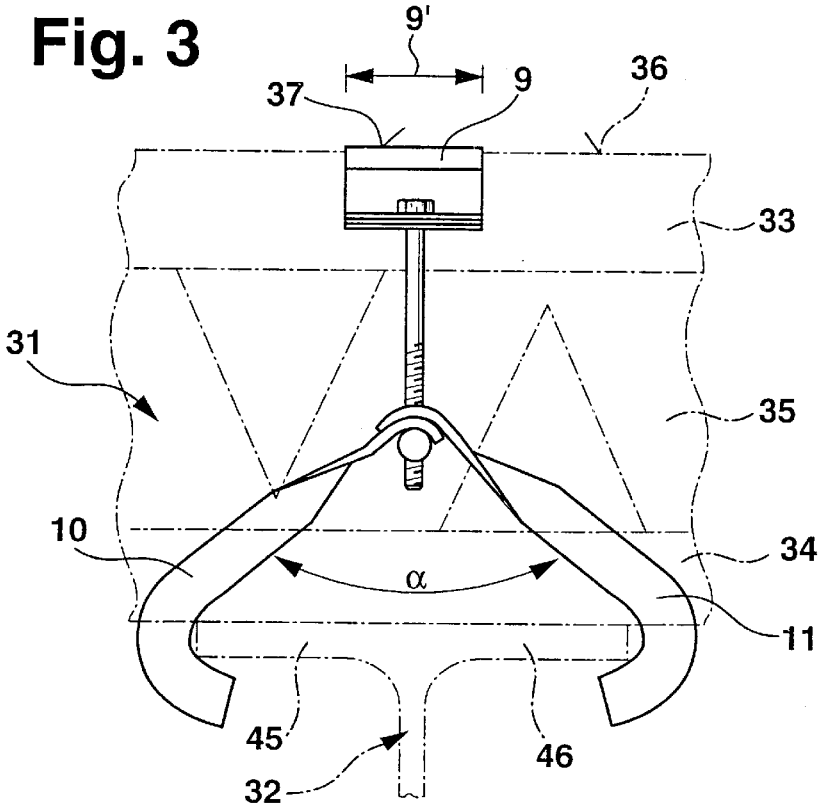
FIG. 3 shows a side view of a hook strap in accordance with the invention.

A symmetrically designed hook strap serves as a connecting element between the formwork girder 1 and the waler 2. The hook strap comprises essentially: Firstly, a transverse arm formed as a flat ribbon 9 of small wall thickness. The ribbon 9 overlaps the top flange 3 and has a ribbonwidth 9', as shown in FIG. 3. Secondly, two hook-shaped retainers 10 and 11, disposed in the shape of a V, are formed on both sides of the formwork girder 1 which are supported on a common tension element formed like a tensioning nut 12 and disposed on same in a pivotable manner. Thirdly, tension elements are formed through which the retainers 10 and 11 can be tensioned. The ribbon 9 is reinforced by angle sections 15, 15', 16,16' in the area of the ribbon surfaces 13 and 14. The ribbon 9 is guided around the top flange 3 in the shape of a U. The ribbon 9 terminates in edge sections 17, 18 which hold the ribbon in a tension-proof fashion. The ribbon 9 is supported on the top flange side facing a formwork panel (the formwork panel is not shown in the drawings).

The ribbon 9 is retained between the angle sections 15, 15', 16, 16'. The angle sections 15, 15', 16, 16' may be welded, riveted or screwed to the ribbon 9. In another embodiment, the ribbon ends may be wound additionally about the angle sections 15,16 to provide permanent connection between the ribbon 9 and the angle sections 15, 15', 16, 16'. In this embodiment, the ribbon 9 can accommodate large tensioning forces.

Tension elements in the form of studs 1 9 and 20 are retained at the edge sections 17, 1 8 which penetrate through bores in the angle sections 15 and 16. The studs 19, 20 are retained in the angle sections 15 and 16 via screw heads 21, 22. A reduction of the separation between tensioning nut 12 and screw head 21 or 22 pulls the retainers 10 and 11 in the direction of the top flange 3 such that the free hook strap ends 23, 24 engage like hooks below the flanks 25 and 26 of the waler 2 and increase its pressure onto the formwork girder thereby producing the detachable rigid connection between formwork girder 1 and waler 2. Large differences in height of the girders can be compensated for by using studs 19,20 of different lengths. Small differences in height of the girders can be compensated for with the same studs.

FIG. 3 shows that the angle α between the retainers 10 and 11 can be varied. A waler 32 having flanks 45, 46 can be connected to a formwork girder 31 by means of the same hook strap shown in FIG. 1 and FIG. 2. Whereas the formwork girder 1 comprises only one full-material strut as connection between top flange 3 and bottom flange 4, the connection between top flange 33 and bottom flange 34 of the formwork girder 31 is effected via diagonal lattice struts 35 (lattice girder 31).

The ribbon 9 overlaps the top flange 33 in such a fashion that application of material onto the upper side of the top flange 33 is not visible. Reference numeral 9' designates the width of the ribbon. The ribbon 9 disposed on the top flange 33 is hardly visible due to the small wall thickness of approximately 0.2 mm and a ribbonwidth of approximately 70 mm. One upper side 37 of the ribbon 9 hardly projects beyond the upper side 36 of the flange. The formwork panel abuts the flange upper surface 36 almost flatly. If the formwork girder consists of wood or a similar soft material, the ribbon 9 may dig into the material of the base surface of a top flange facing the formwork panel during tensioning of the hook strap, thereby producing a continuous smooth surface on the top flange surface facing the formwork panel skin.

The angle α shows that the retainers 1 0 and 11 can be pivoted in the tension-less state to allow an increase or reduction of the angle α.

Figure 4:
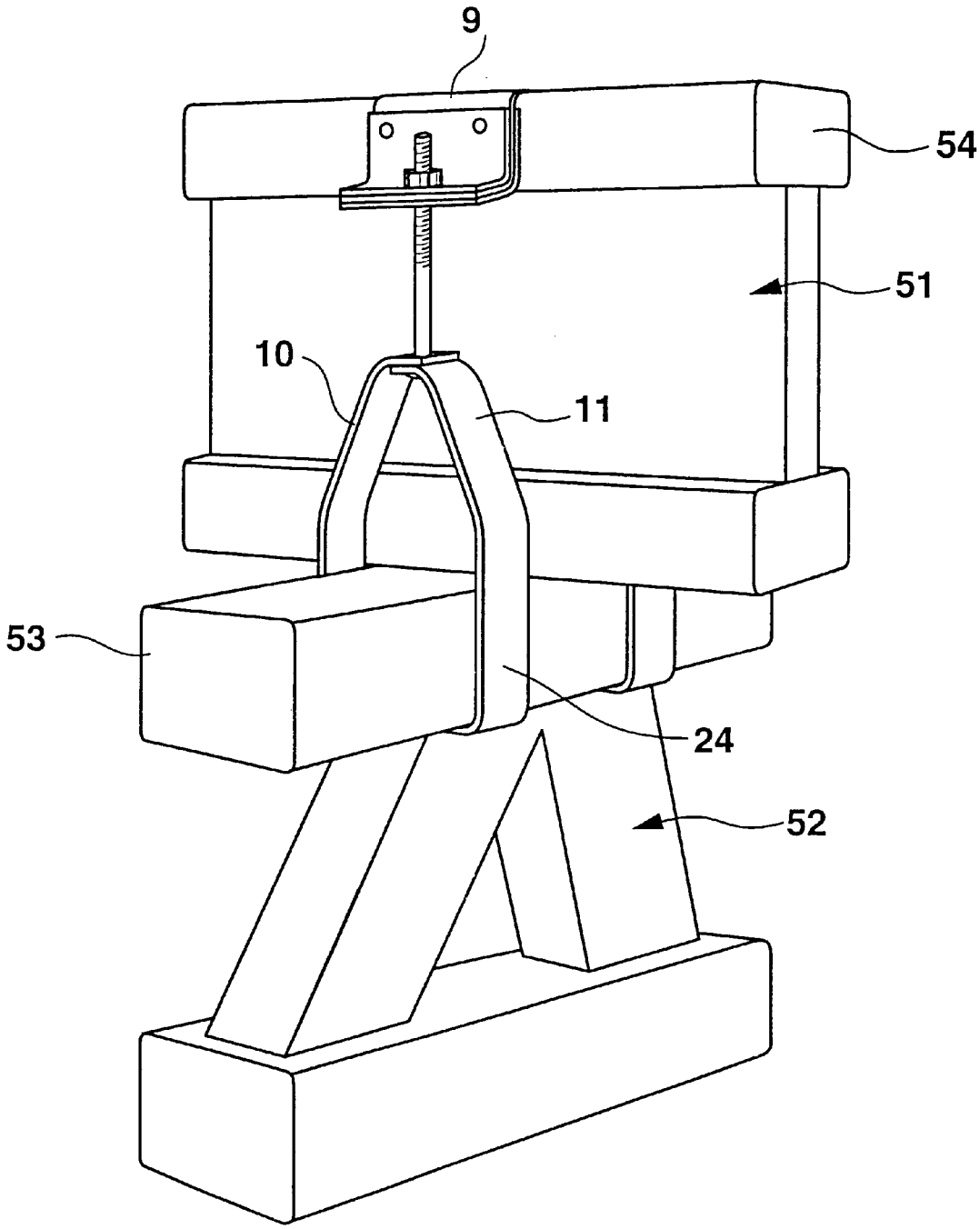
FIG. 4 shows a spatial representation of girder sections which are connected to an inventive hook strap.

FIG. 4 shows a further embodiment of an inventive hook strap including the use of the ribbon 9. A girder 51 is rigidly connected with a lattice girder 52 such that the hook strap ends, one of which is designated with reference numeral 24, engage below a flange 53 of the lattice girder 52. The ribbon 9 is guided above a top flange 54 of the girder 51. The free ends of the retainers 10, 11 have a wide surface to ensure that they do not dig into the wooden lattice girder 52 under tension.

I claim:

1. Hook strap comprising a transverse arm for abutment on a formwork girder having hook-shaped retainers disposed on opposite ends of the transverse arm for engagement below parts of a waler and tension elements for fixing the hook strap, wherein the transverse arm is formed as a non-rigid flat ribbon of small thickness which can be adapted to formwork girders of different widths by conforming to the girder width without preforming the flat ribbon.

2. Hook strap comprising a transverse arm for abutment on a formwork girder having hook-shaped retainers disposed on opposite ends of the transverse arm for engagement below parts of a waler and tension elements for fixing the hook strap, wherein the transverse arm is formed as a non-rigid fiat ribbon of small thickness and wherein the surface produced by the fiat ribbon and the formwork girder is largely uniform and free of projecting steps or edges.

3. Hook strap comprising a transverse arm for abutment on a formwork girder having hook-shaped retainers disposed on opposite ends of the transverse arm for engagement below parts of a waler and tension elements for fixing the hook strap, wherein the transverse arm is formed as a non-rigid fiat ribbon of small thickness which can be adapted to formwork girders of different widths by conforming to the girder width without preforming the flat ribbon, and wherein the surface produced by the fiat ribbon and the formwork girder is largely uniform and free of projecting steps or edges, and wherein the ribbon forms a U-shaped recess during overlapping of the formwork girder, wherein the size of the U-shaped recess is adapted to the width of a flange of the formwork girder and the ends of the ribbon are provided with edge sections which are connected with tension elements.

4. The hook strap of claim 1, wherein the ribbon has a width of approximately 70 mm and a ribbon thickness of less than 1 mm.

5. The hook strap of claim 2, wherein the ribbon has a width of approximately 70 mm and a ribbon thickness of less than 1 mm.

6. The hook strap of claim 3, wherein the ribbon has a width of approximately 70 mm and a ribbon thickness of less than 1 mm.

7. The hook strap of claim 3, wherein the edge sections are formed as angle sections which retain the ends of the ribbon in a tension-proof fashion.

8. The hook strap of claim 1, wherein the ribbon overlaps a top flange of the girder.

9. The hook strap of claim 2, wherein the ribbon overlaps a top flange of the girder.

10. The hook strap of claim 3, wherein the ribbon overlaps a top flange of the girder.

11. The hook strap of claim 1, wherein the tension elements are formed by studs of different length, comprising screw heads, and a tensioning nut.

12. The hook strap of claim 2, wherein the tension elements are formed by studs of different length, comprising screw heads, and a tensioning nut.

13. The hook strap of claim 3, wherein the tension elements are formed by studs of different length, comprising screw heads, and a tensioning nut.

14. The hook strap of claim 3, wherein the edge sections are formed as angle sections which retain the ends of the ribbon in a tension-proof fashion, and wherein the angle sections are surrounded by the end areas of the ribbon.

* * * * *